US006509923B2

(12) United States Patent
Morita et al.

(10) Patent No.: US 6,509,923 B2
(45) Date of Patent: Jan. 21, 2003

(54) INNER DRUM TYPE IMAGE RECORDING DEVICE

(75) Inventors: Hajime Morita, Shizuoka-ken (JP); Yuji Tanaka, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/748,112

(22) Filed: Dec. 27, 2000

(65) Prior Publication Data

US 2001/0017648 A1 Aug. 30, 2001

(30) Foreign Application Priority Data

Dec. 27, 1999 (JP) ..... 11-371538

(51) Int. Cl.[7] ..... B41J 2/435
(52) U.S. Cl. ..... 347/262; 347/264
(58) Field of Search ..... 347/260, 262, 347/264, 139; 359/236, 608, 614

(56) References Cited

U.S. PATENT DOCUMENTS 5,589,900 A 12/1996 Sterflinger ..... 396/548
5,671,005 A * 9/1997 McNay et al. ..... 347/262
5,844,589 A 12/1998 Orlicki et al. ..... 347/141

FOREIGN PATENT DOCUMENTS

EP 0 818 307 A1 1/1998
JP 10-162127 6/1998 ..... G06T/1/00

* cited by examiner

*Primary Examiner*—Hai Pham
(74) *Attorney, Agent, or Firm*—Sughrue Mion, PLLC

(57) ABSTRACT

An inner drum type image recording device is provided which, in exposure of a photosensitive lithographic printing plate, eliminates unnecessary light (reflected scattered light) other than light for main exposure, and eliminates fluctuations in a dot percent. By limiting baffles to a minimum number of positions necessary, fluctuations in the dot percent caused by reflected scattered light are suppressed, and a sufficient space needed for maintenance work on a spinner mirror and the like can be ensured. Further, by making the baffle fan-shaped and disposing the baffle at a periphery of the spinner mirror, light of a subscanning component of reflected scattered light can be reliably blocked.

21 Claims, 8 Drawing Sheets

INNER DRUM TYPE IMAGE RECORDING DEVICE

BACKGROUND OF THE INVENTION

1. Field of the Invention

The present invention relates to an inner drum type image recording device in which a recording medium is set in close contact with and supported by an inner peripheral surface of a support which is formed in a circular-arc shape, and an image is recorded on the recording medium by rotating a spinner mirror and moving the spinner mirror in the axial direction of the support.

2. Description of the Related Art

In a CTP (computer-to-plate) technique for a photosensitive lithographic printing plate having a photopolymerizable layer (hereinafter referred to as a photopolymer plate), an inner drum type image recording device is used as a device for recording an image on the photopolymer plate. In the inner drum type image recording device, the photopolymer plate is disposed along the inner peripheral surface of a circular-arc-shaped support. By rotating a spinner mirror which is disposed at the center of the circular arc of the support, a light beam, which is incident on the reflecting mirror surface of the spinner mirror from an axial direction of the spinner mirror, is reflected toward the photopolymer plate and main scanning is carried out. The spinner mirror moves at a uniform velocity in the axial direction, and this movement is subscanning. In this way, light is main scanned and subscanned on the photopolymer plate such that an image is recorded thereon.

In the above-described inner drum type image recording device, the light which is reflected by the spinner mirror and is to be focussed on the photopolymer plate is reflected at the photopolymer plate surface. Depending on the angle of reflection thereof, the light may reach a different position on the photopolymer plate. Because this further reflected light is dispersed light, it is thus not concentrated at one point, and rather, is randomly reflected (reflected scattered light). The effect on the photopolymer plate surface caused by this reflected scattered light is shown in FIG. 9 as a dot percent characteristic based on an image signal expressing uniform halftone dots.

In the case of a negative-type photopolymer plate, a phenomenon known as flare occurs in which the dot percent is high due to the reflected scattered light. As shown in FIG. 9, much flare can be seen at the both ends in the main scanning direction, and flare is great at the subscanning direction rear end side (subscanning completed side) (i.e., there is little flare at the side which has not yet been subscanned).

Other causes of flare in addition to reflected scattered light include the characteristics of the laser beam (the beam diameter, the beam focus, the beam profile, and the like), the extinction ratio of the modulator, the rise time/fall time of the laser, and the like.

Here, in order to mitigate the effect of the reflected scattered light, structures have been proposed in which light-shielding plates called baffles are provided in the radial direction from the rotation axis center of the spinner mirror toward the inner peripheral surface of the support (as one example, see Japanese Patent Application Laid-Open (JP-A) No. 10-162127). A baffle is provided at the front and at the back of the spinner mirror (at both the un-subscanned side and the already subscanned side). A plurality of baffles are provided in order to divide the space above the support into units of predetermined angles. In this way, the light reflected from the spinner mirror does not reach regions at the outer sides of the divided space, and therefore, the reflected scattered light can be reduced by that much.

However, a path for a moving mechanism for placing the photopolymer plate on the peripheral surface of the support must be ensured at the side end portions of the photopolymer plate at the baffles, and there is the possibility that, structurally, a predetermined gap may be formed. As a result, the reflected scattered light leaks from this gap, and flare occurs.

As mentioned above, the conventional baffles are provided at the front and back of the spinner mirror. Therefore, when the spinner mirror must be fixed or serviced, there is little room for the maintenance work to be carried out in, and a secondary problem arises in that workability is poor.

SUMMARY OF THE INVENTION

In view of the aforementioned, an object of the present invention is to provide an inner drum type image recording device in which flare can be prevented by suppressing leaking of reflected scattered light from gaps which are required from a structural point of view, while using as few baffles as possible.

A first aspect of the present invention is a device for use in recording an image on a recording medium with a light beam, the device comprising: a support having a surface for supporting a recording medium; a shaft provided substantially parallel to the surface of the support; a mirror provided so as to be rotatable around the shaft and movable along the shaft, and while reflecting a light beam onto the recording medium, the mirror carrying out main scanning by rotating around the shaft and subscanning by moving along the shaft, the mirror having opposite sides along a direction of the subscanning; and a shield provided to be movable with the mirror, on only one side of the mirror, for blocking scattered reflections of the light beam from the mirror.

A second aspect of the present invention is an inner drum type image recording device for use in recording an image on a recording medium with a light beam, the device comprising: a support having an arcuate cross-section, with an inner peripheral surface for receiving a recording medium in contact therewith; a spinner mirror provided so as to be rotatable around an axis extending substantially parallel to the inner peripheral surface of the support, and due to the spinner mirror rotating, a light beam radiating from a direction substantially parallel to said axis is reflected for performing main scanning of a recording medium received on the inner peripheral surface of the support, and while the recording medium is being main scanned, the spinner mirror moves lengthwise along the axis for performing subscanning of the recording medium such that an image is recorded on the recording medium in accordance with the reflected light beam; and a baffle provided along a direction from which the light beam radiates, between the spinner mirror and the light beam for blocking scattered reflections of the light beam from the mirror, the mirror including a rear side facing away from the baffle towards a space substantially devoid of structure for blocking scattered reflections of the light beam reflected by the mirror.

A third aspect of the present invention is a method for blocking scatter reflections of a light beam from a spinner mirror in a drum type image recording device having a drum in which a recording medium is received, the method comprising: (a) main scanning a recording medium in the drum by receiving the light beam with the spinner mirror and rotating the spinner mirror to reflect the light beam circumferentially, relative to the drum, along the recording medium; (b) subscanning the recording medium by moving the spinner mirror lengthwise along the drum, while performing main scanning to reflect the light beam transversely, relative to a direction in which main scanning is performed, along the recording medium; (c) moving a light shield in correspondence with the mirror to impede optical paths in reflection scatter directions from the mirror to sections of the recording medium which have been main scanned with the light beam; and (d) leaving optical paths in reflection scatter directions substantially unimpeded from the mirror to sections of the recording medium, which have not been main scanned.

In accordance with the present invention, a baffle is only placed at the rear side of subscanning movement. Namely, there is no need for a baffle for blocking light at the subscanning front side (the side at which subscanning has not been carried out). The reason for this is that, because the effect of scattered reflected light on the subscanning front side is slight, the image quality does not deteriorate even if no baffle is provided. By keeping the number of baffles to a minimum, space is provided for maintenance work on the spinner mirror or the like, and workability improves.

DESCRIPTION OF THE PREFERRED EMBODIMENTS

Figure 1A:
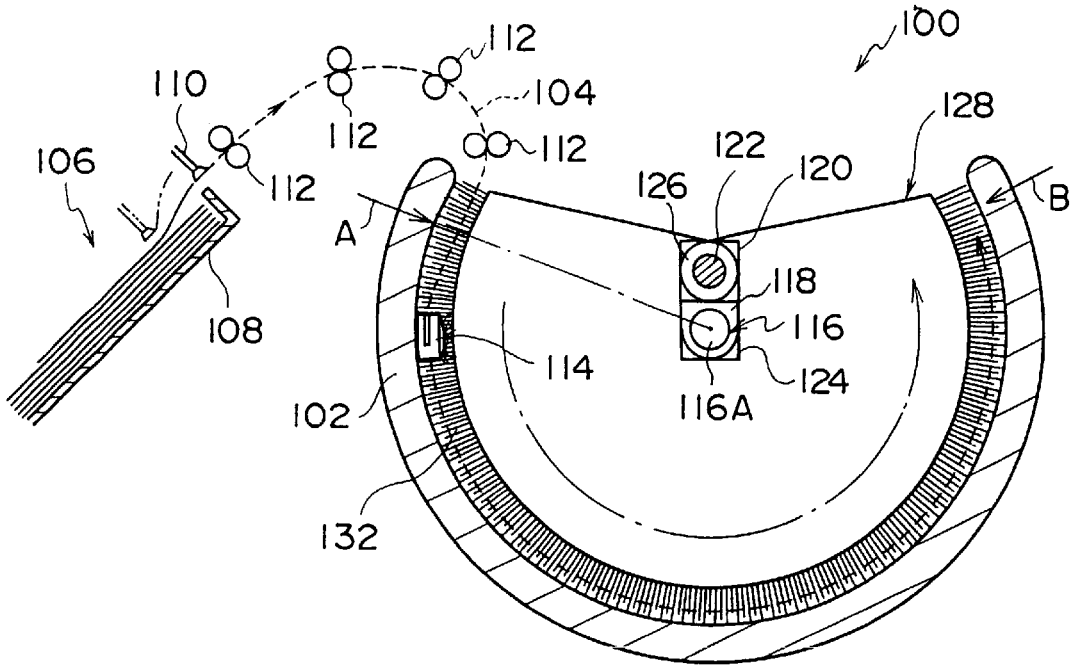
FIG. 1A is a front view of an inner drum type image recording device relating to a first embodiment of the present invention.
Figure 1B:
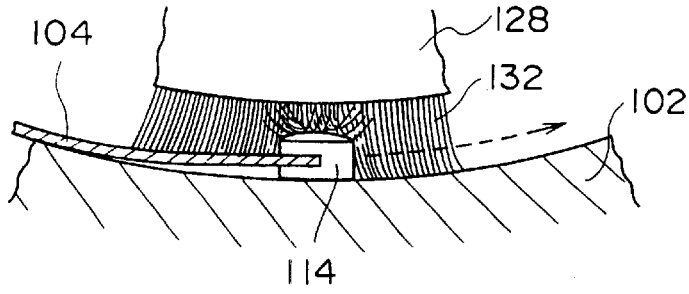
FIG. 1B is an enlarged view of a vicinity of a support when a suction conveying portion moves.
Figure 2:
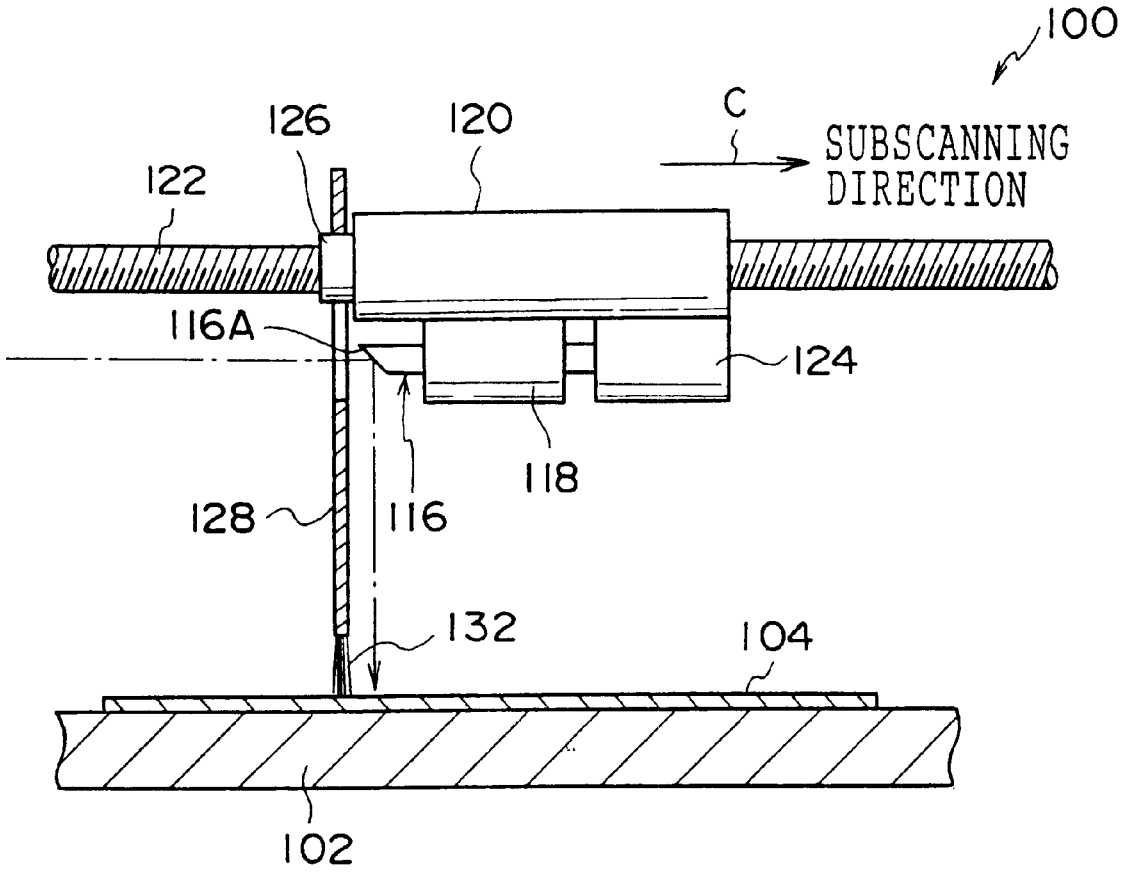
FIG. 2 is a side view of the inner drum type image recording device relating to the first embodiment of the present invention.
Figure 3:
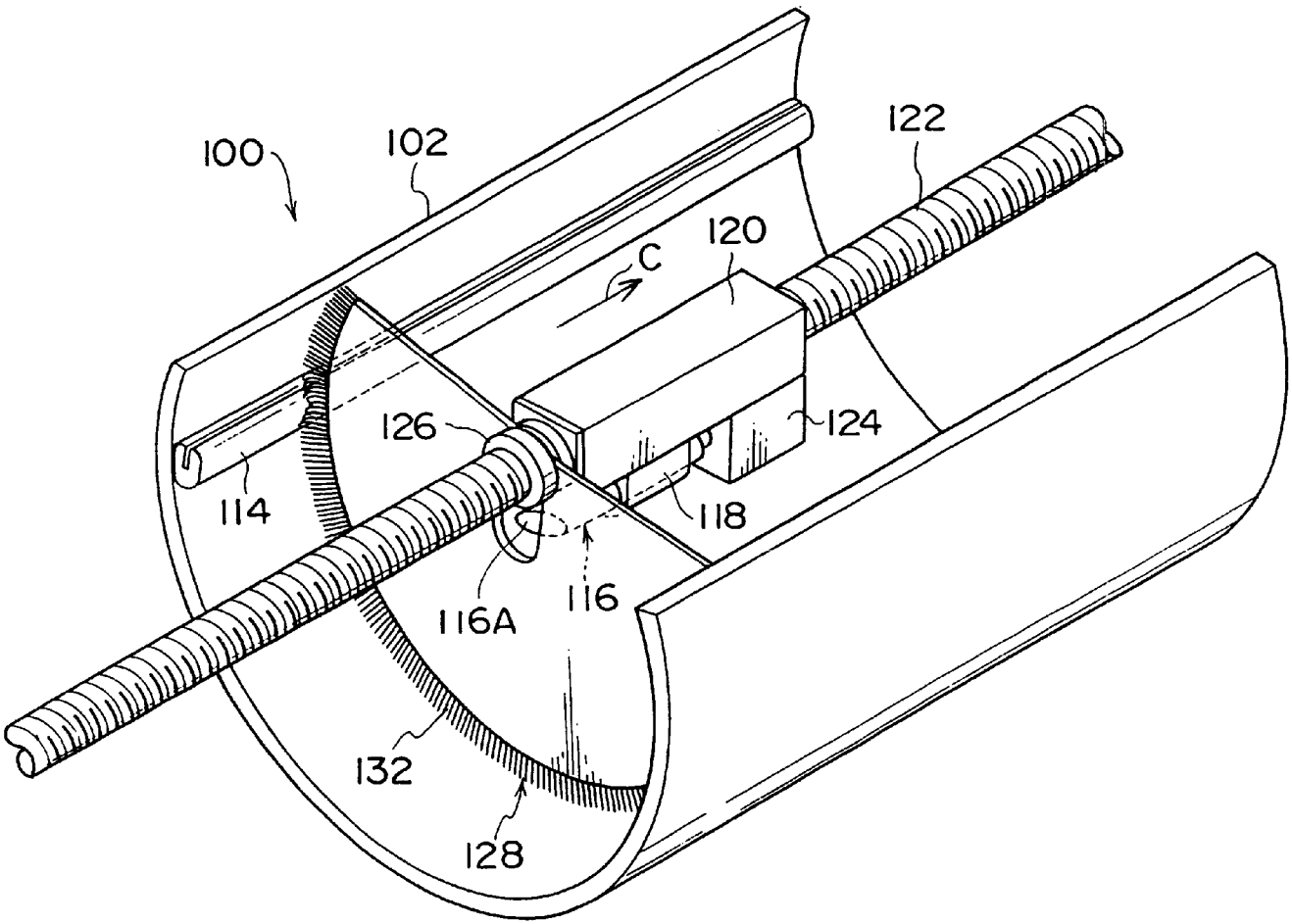
FIG. 3 is a perspective view of the inner drum type image recording device relating to the first embodiment of the present invention.

FIGS. 1 through 3 are schematic structural views of an inner spinner image recording device 100 relating to a first embodiment of the present invention.

The main portion of the inner spinner image recording device 100 is a support 102 which has a circular-arc-shaped cross-section. A photopolymer plate 104 serving as a recording medium is supported along the inner peripheral surface of the support 102. Note that the recording medium is not limited to the photopolymer plate 104, and may be an ordinary PS plate or a silver halide photosensitive material.

A sheet device 106 is provided at the left side, in FIG. 1, of the support 102. The sheet device 106 is formed by a cartridge 108 in which the photopolymer plates 104 are stacked and housed, a removing suction mechanism portion 110 which sucks the topmost photopolymer plate 104 from the cartridge 108, and a plurality of pairs of conveying rollers 112 which nip the photopolymer plate 104 which has been removed by the suction mechanism portion 110 and guide and convey the photopolymer plate 104 to the opening of the support 102. Note that guide plates or belt conveyers (both not shown) are provided between the conveying rollers 112 such that the photopolymer plate 104 can be reliably transferred to the next conveying rollers 112.

A long, thin suction conveying portion 114 is provided at the inner peripheral surface of the support 102 from the near side to the far side in the direction orthogonal to the surface of the drawing of FIG. 1. The suction conveying portion 114 is provided with a suction portion so as to suck and hold the leading end portion of the photopolymer plate 104 which is conveyed in through the opening portion of the support 102 by the conveying rollers 112.

The suction conveying portion 114 is movable along the inner peripheral surface of the support 102. When the photopolymer plate 104 is to be sucked and held, the photopolymer plate 104 is positioned at an initial position (the position of point A in FIG. 1A). Here, when the photopolymer plate 104 is sucked and held by the suction portion, the photopolymer plate 104 moves along the inner peripheral surface of the support 102 due to the driving force of a driving means (not shown), and is stopped at a final position (the position of point B in FIG. 1A).

The photopolymer plate 104 is disposed along the inner peripheral surface of the support 102 due to movement of the suction conveying portion 114. Suction holes (not shown) are formed in the support 102 such that the highly rigid photopolymer plate 104 can be reliably set in close contact with the inner peripheral surface of the support 102 due to the suction force from the suction holes.

A spinner mirror 116 is provided at a central position of the circular arc of the support 102. As illustrated in FIG. 2, the distal end portion of the spinner mirror 116 is cut obliquely. A reflecting mirror surface 116A is formed at the cut surface. The axial direction intermediate portion of the spinner mirror 116 is shaft-supported by a bracket 118.

The bracket 118 is formed in a substantial U-shape. The top end portion thereof is fixed to the lower end portion of a moving block 120.

The moving block 120 is screwed together with a male screw shaft 122 disposed parallel to the axis of the spinner mirror 116. The male screw shaft 122 can be rotated due to the driving force of a driving means (not shown). Rotation of the moving block 120 around the male screw shaft 122 is prevented by a guide portion (not shown). As a result, when the male screw shaft 122 is rotated, the screwed position of the moving block 120 successively changes, and thus, the moving block 120 moves in the axial direction of the male screw shaft 122. This movement is at a uniform velocity, and is subscanning movement (from the left to the right in FIG. 2, i.e., in the direction of arrow C in FIG. 2).

The base portion of the spinner mirror 116 shaft-supported at the bracket 118 is connected to the rotating shaft of a motor 124. The motor 124 is fixed to the lower end portion of the moving block 120. Here, the spinner mirror 116 can be rotated by the rotating driving force of the motor 124. The rotational speed of the spinner mirror 116 is constant.

A laser beam from an image signal output device (not shown) is inputted to the axial center of the reflecting mirror surface 116A of the spinner mirror 116, and is reflected by the reflecting mirror surface. Accordingly, by rotating the spinner mirror 116, the laser beam is scanned on the inner peripheral surface of the support 102, i.e., on the surface of the photopolymer plate 104. This scanning is the main scanning.

In the above-described structure, by carrying out main scanning and subscanning simultaneously, an image can be recorded on the surface of the photopolymer plate 104.

Here, as illustrated in FIG. 3, a tubular fixing member 126 is mounted to the subscanning direction movement rear side end surface of the moving block 120. The inner peripheral side end portion of a fan-shaped baffle 128 is fit into a ring-shaped groove formed in the peripheral direction of the fixing member 126. The baffle 128 extends toward the inner peripheral surface of the support 102 from the fit-in position. The outer peripheral side end portion of the baffle 128 is positioned such there is a slight gap between the end portion and the support 102. This gap is the locus of movement along which the suction conveying portion 114 moves. Due to this gap, the baffle 128 and the suction conveying portion 114 do not interfere with one another.

The baffle 128 functions to prevent flare (uneven halftone dots) from occurring due to the randomly reflected light of the light reflected from the reflecting mirror surface 116A of the spinner mirror 116 being incident on the surface of the polymer plate 104 at a position which is different than the main scanning position.

Here, the reason why the baffle 128 is disposed only at the subscanning rear side (i.e., at the side at which the subscanning has been completed) is that, in the region in which subscanning (exposure) is completed, the sensitivity is increased, and the photopolymer plate 104 may be exposed due to light which leaks (random reflection) being incident on the photopolymer plate 104. Accordingly, there is no need to provide a baffle 128 at the subscanning direction front side (the unscanned side). In this case, an unexpected effect can be achieved in that space to enable maintenance work on the spinner mirror 116 and the like is created due to this omission of the baffle 128 at the subscanning direction front side.

Further, in the present first embodiment, brush bristles 132 are provided at the outer peripheral side end portion of the baffle 128, i.e., at the support 102 side end portion of the baffle 128. The material, bristle diameter, and the like of the brush bristles 132 are not particularly limited, but it is preferable that the density thereof is such that the transmission rate of light therethrough is near 0%. Due to the brush bristles 132, an effect which is equivalent to a case in which no gap were provided at the baffle 128 can be achieved. Because the brush bristles 132 elastically deform when they interfere with the movement of the suction conveying portion 114, although there is some interference, it does not impede movement of the suction conveying portion 114 in any way (see FIG. 1B).

Next, operation of the present first embodiment will be explained.

With the suction conveying portion 114 at its initial position, i.e., with the suction conveying portion 114 at the position of point A in FIG. 1, operation of the sheet device 106 is started.

At the sheet device 106, first, the suction mechanism portion 110 sucks and removes the topmost photopolymer plate 104 accommodated in the cartridge 108.

The leading end portion of the removed photopolymer plate 104 is nipped by the conveying rollers 112. Due to the rotating driving force of the conveying rollers 112, the photopolymer plate 104 is transferred to the subsequent conveying rollers 112, and reaches the opening portion of the support 102.

At this position, while the photopolymer plate 104 is being conveyed, it is inverted and is guided to the inner peripheral surface of the support 102. Here, when the leading end portion of the photopolymer plate 104 corresponds to the suction conveying portion 114 positioned at its initial position, the suction portion of the suction conveying portion 114 sucks the surface of the photopolymer plate 104. After suction, the suction conveying portion 114 begins moving along the inner peripheral surface of the support 102, and stops at its final position (point B in FIG. 1A). Thereafter, when suction from the suction holes provided in the support 102 is started, the photopolymer plate 104 is held in close contact with the inner peripheral surface of the support 102.

The brush bristles 132, which are a portion of the baffle 128, exist on the locus of movement of the suction conveying portion 114, and therefore interfere with the suction conveying portion 114. However, due to the brush bristles 132 interfering with the suction conveying portion 114, the brush bristles 132 elastically deform, and therefore, do not impede the movement of the suction conveying portion 114 (see FIG. 1B).

When the photopolymer plate 104 is positioned at a predetermined position, the laser beam is outputted from the image signal output device, and main scanning movement (rotation of the spinner mirror 116) and subscanning movement (rotation of the male screw shaft 122) begin. The laser beam is incident on the reflecting mirror surface along the axis of the spinner mirror 116.

In this way, the laser beam is scanned on the surface of the photopolymer plate 104, and the image is recorded.

Here, the light which is reflected from the reflecting mirror surface 116A of the spinner mirror 116, and the reflected light after focusing onto the photopolymer plate 104 scatter, are irradiated onto a different position of the photopolymer plate 104, and cause flaring.

Figure 4:
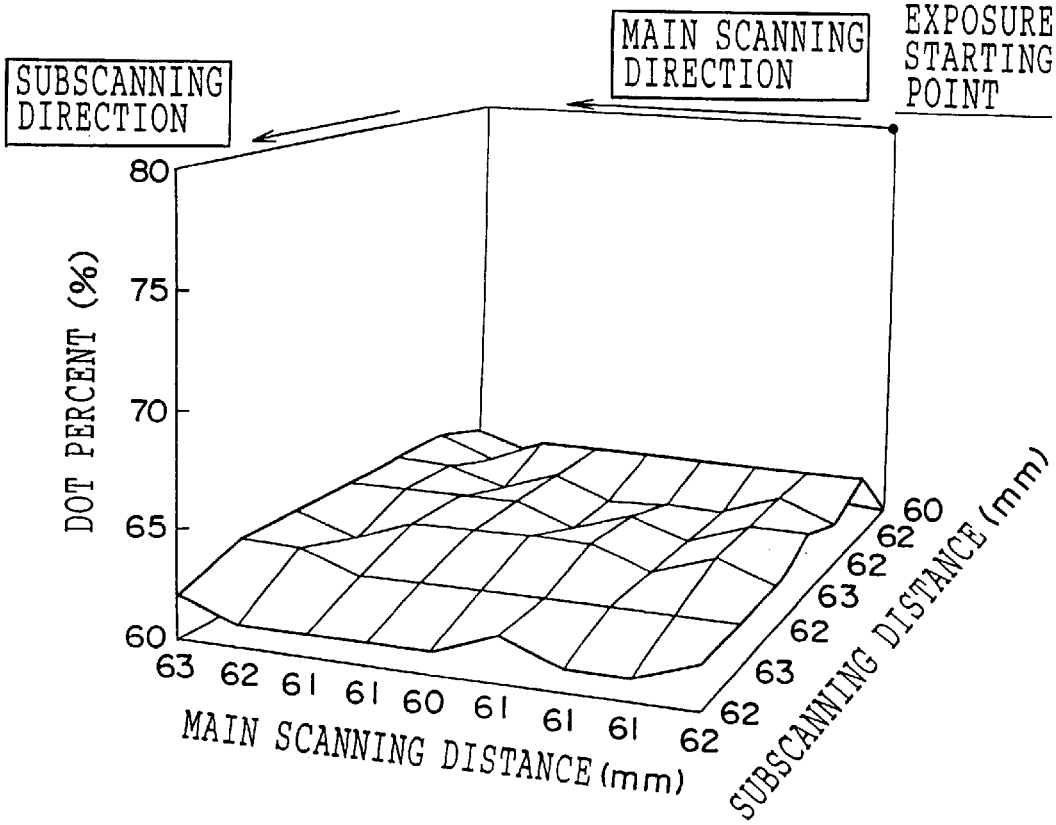
FIG. 4 is a characteristic diagram of a dot percent for showing the extent of the effects of flare in the structure of the first embodiment of the present invention.
Figure 9:
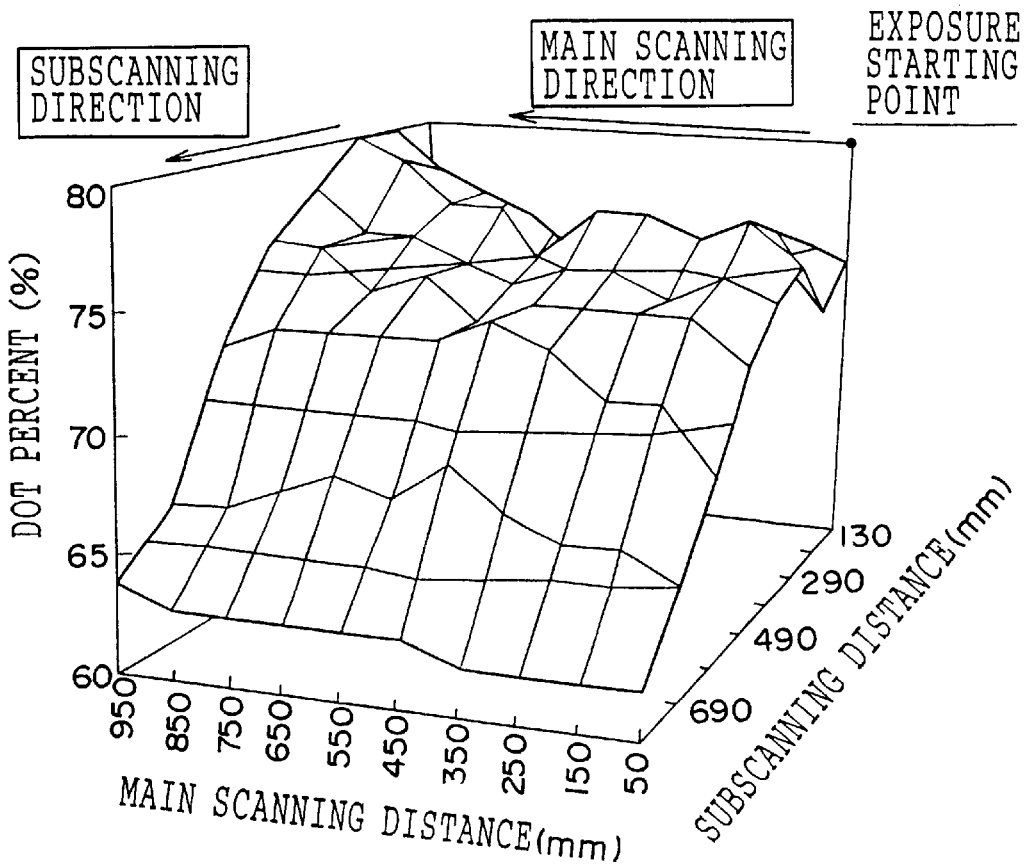
FIG. 9 PRIOR ART
FIG. 9 is a characteristic diagram showing a dot percent for showing the extent of the effects of flare in a conventional example (in which no baffles are provided).

However, in the present first embodiment, the fan-shaped baffle 128 is provided in a vicinity of the reflecting mirror surface 116A of the spinner mirror 116 (in the present first embodiment, at the subscanning direction rear side of the reflecting mirror surface 116A). Thus, scattered light of the subscanning components can be prevented from reaching the photopolymer plate 104. The effects due to this provision of the baffle 128 are shown in FIG. 4. As can be seen by comparing FIG. 4 and FIG. 9 which is a characteristic diagram in a case in which no baffle 128 is provided, in the subscanning direction, as well as in the main scanning direction, a substantially uniform dot percent can be achieved.

The reason why the baffle 128 is provided only at the scanning direction rear side is that the regions for which scanning has been completed and on which the image is recorded already have high sensitivity, and can be exposed by even a small amount-of light which has leaked (scattered reflected light). In this way, a large space is provided at the subscanning front side, which large space can be used as space for carrying out maintenance work on the spinner mirror 116, the motor 124, or the like. Thus, the workability improves.

Figure 5:
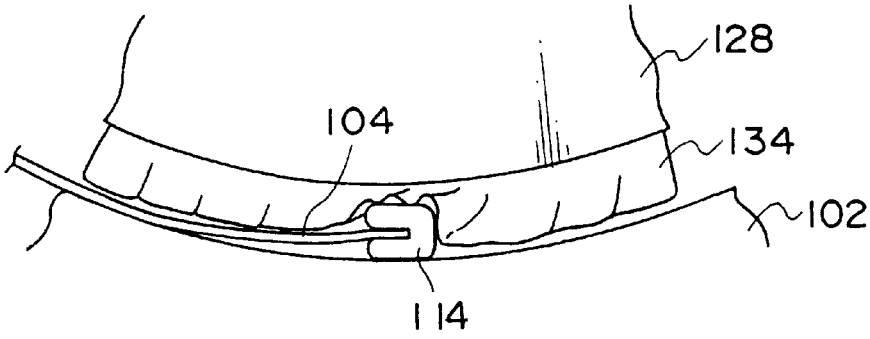
FIG. 5 is an enlarged view of a modified example of a member provided at a baffle end portion for avoiding the suction conveying portion, wherein the member is made of fabric.
Figure 6:
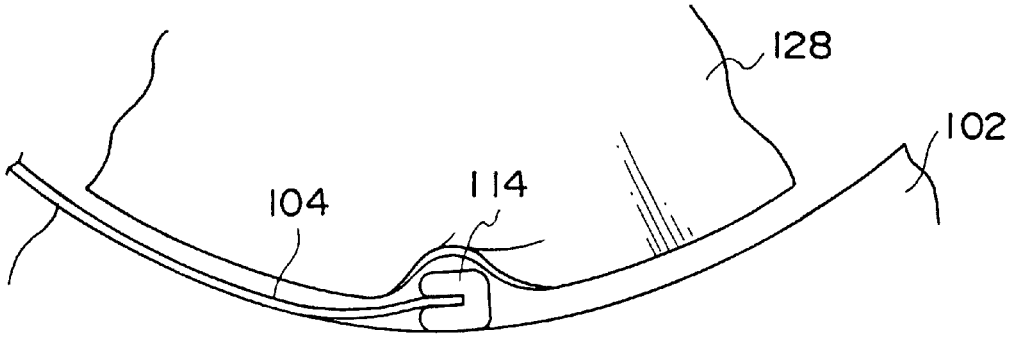
FIG. 6 is an enlarged view of a modified example of a member provided at a baffle end portion for avoiding the suction conveying portion, wherein the baffle itself is a flexible member.

In the present first embodiment, the brush bristles 132 are provided at the support 102 side end portion of the baffle 128, such that light is completely blocked and the brush bristles 132 do not impede movement of the suction conveying portion 114. However, the present invention is not limited to the brush bristles 132. A curtain 134 made of fabric such as shown in FIG. 5 may be used, or the baffle 128 itself may be formed by a flexible member as shown in FIG. 6. In this way, due to the elastic deformation of the baffle 128, the movement of the suction conveying portion 114 is not impeded. The material of the baffle 128 in this case is preferably a synthetic resin such as polyvinyl chloride, polyethylene, or the like.

Second Embodiment

Next, a second embodiment of the present invention will be explained. In the present second embodiment, the same structural parts as those of the first embodiment are denoted by the same reference numerals, and description thereof is omitted.

Figure 7:
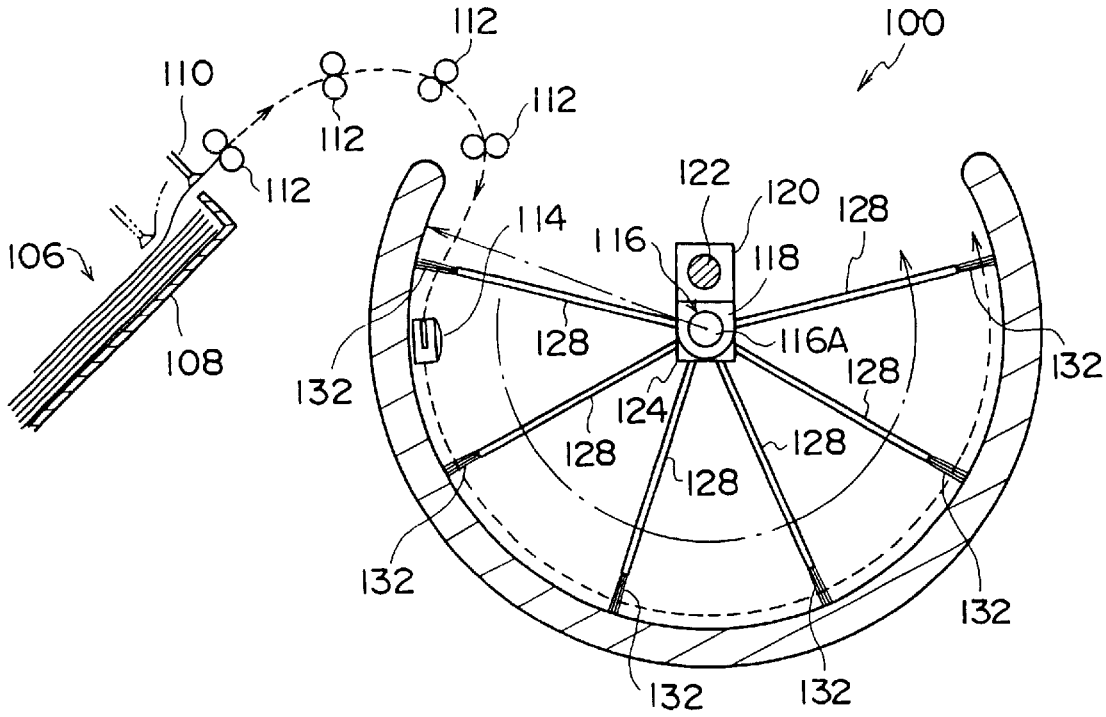
FIG. 7 is a perspective view of an inner drum type image recording device relating to a second embodiment of the present invention.
Figure 8:
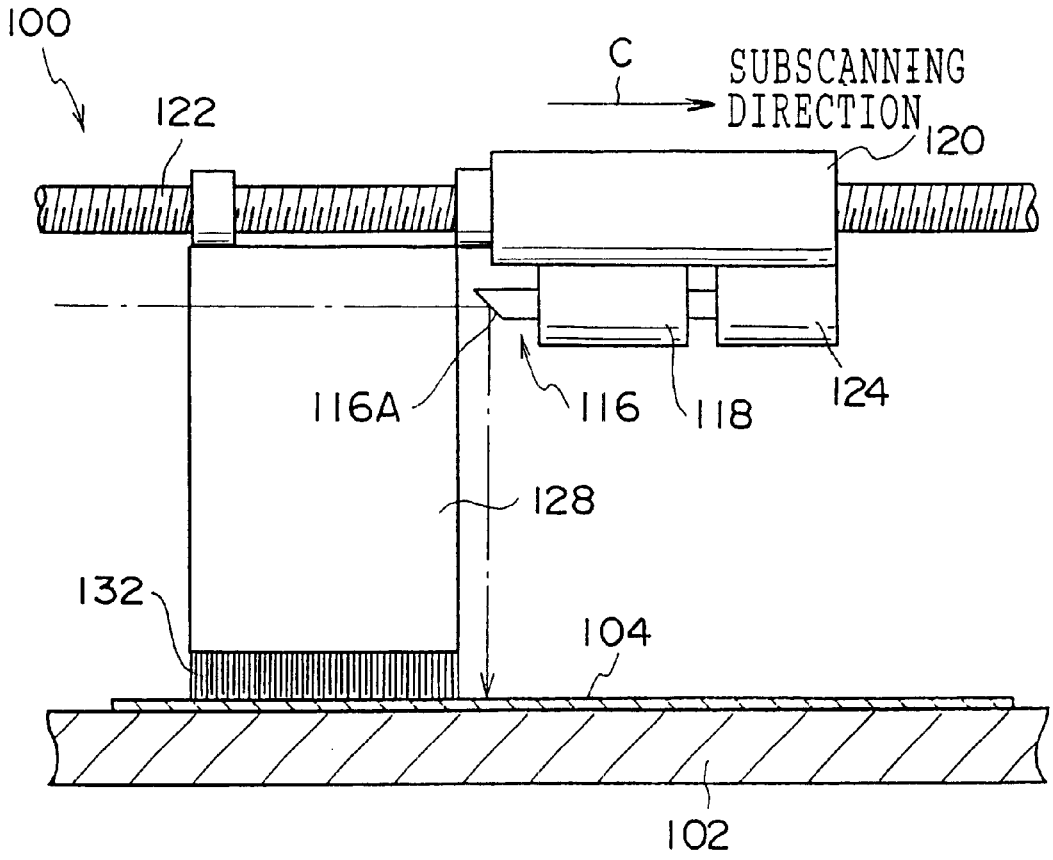
FIG. 8 is a side view of the inner drum type image recording device relating to the second embodiment of the present invention.

The feature of the present second embodiment is, as illustrated in FIG. 7, that the baffle 128 is disposed radially such that one side thereof is directed toward the axis of the spinner mirror 116 and the opposing side thereof is disposed in a vicinity of the support 102. Note that the baffle 128 is only disposed at the subscanning rear side (i.e., the side which has already been subscanned) (see FIG. 8).

In the present second embodiment, six baffles 128 are disposed radially so as to demarcate five spaces. In FIG. 7, the brush bristles 132 are attached to the support 102 side end portion of each baffle 128. When the suction conveying portion 114 moves, the brush bristles 132 deform so as to not impede movement of the suction conveying portion 114, which is the same structure as in the first embodiment. Accordingly, the brush bristles 132 may be replaced by a curtain made of fabric, or the baffle 128 itself may be formed by a flexible member.

In accordance with the above-described first and second embodiments, by providing the baffles 128 at the minimum number of positions, variation in the dot percent due to flare can be suppressed, and sufficient space required for maintenance work on the spinner mirror 116 or the like can be ensured. Further, by providing the baffle 128 in a fan-shape around the spinner mirror 116, the light of the subscanning direction component, by which flare is mainly generated, can be reliably blocked.

In accordance with the present invention, the baffle is formed by a plurality of thin plates which are rectangular. One end of each thin plate is provided along the rotational axis direction of the spinner mirror and extends radially to a vicinity of an inner peripheral surface of the support. The baffle blocks the scattered reflected light of the main scanning direction component from the illuminated position of the light beam.

In accordance with the present invention, the baffle is disposed in the radial direction from the axis of the spinner mirror. Thus, the scattered reflected light of the main scanning direction component is within a range partitioned by the baffle.

In accordance with the present invention, the baffle is fan-shaped and divides regions along the axial direction of the spinner mirror. Thus, the scattered reflection of the light of the subscanning direction component can be suppressed.

Further, a moving mechanism portion for setting the recording medium along the inner peripheral surface of the support interferes with the support side end portion of the baffle. (The moving mechanism portion is a holding conveying mechanism which holds the leading end of the recording medium and moves the recording medium along the inner peripheral surface of the support.) Thus, in accordance with the present invention, at least this region which interferes is formed of a member which is flexible, e.g., is formed by a thin member made of a synthetic resin such as polyvinyl chloride or polyester. In this way, even if the moving mechanism portion interferes with the baffle, the baffle elastically deforms, and there is no hindrance to the movement of the moving mechanism portion. Further, after interference of the baffle and the moving mechanism portion has ended (i.e., after the baffle has passed the moving mechanism portion), the baffle returns to its original shape, and is not damaged.

In accordance with the present invention, if the portions which interfere with the moving mechanism portion are made of brush bristles, only the small region which actually interferes is deformed, and the light-blocking ability can be maintained. This structure is particularly effective for a fan-shaped baffle.

Further, the same effects can be achieved even if a fabric (woven fabric or non-woven fabric) is used instead of brush bristles.

The inner drum type recording device of the present invention has the excellent effect of preventing flare by using the minimum number of baffles required and by suppressing leaking of reflected scattered light from gaps which are formed as a matter of structural necessity.

What is claimed is:

1. A device for use in recording an image on a recording medium with a light beam, the device comprising:

a support having a surface for supporting the recording medium;

a shaft provided substantially parallel to the surface of the support;

a mirror provided so as to be rotatable around the shaft and movable along the shaft, and while reflecting the light beam onto the recording medium, the mirror carrying out main scanning by rotating around the shaft and subscanning by moving along the shaft, the mirror having opposite sides along a direction of the subscanning; and a shield provided to be movable with the mirror, on only one side of the mirror, for blocking scattered reflections of the light beam from the mirror.

2. A device according to claim 1, wherein the shield is formed from a plurality of substantially rectangular plates, each plate having one side provided along the shaft and extending from the shaft to a vicinity of the surface of the support.

3. A device according to claim 2, wherein the plates are spaced apart at substantially uniform intervals along the surface of the support.

4. A device according to claim 2, wherein at least a support surface side end portion of each of the plates is flexible.

5. A device according to claim 1, wherein the shield is formed from a plate provided substantially orthogonal to the shaft and extends from the shaft to a vicinity of the surface of the support.

6. A device according to claim 5, wherein at least a portion of the plate in the vicinity of the surface of the support is flexible.

7. A device according to claim 1, wherein the support has a shape that is at least partially cylindrical about a central axis, and has an inner peripheral surface which forms the surface for supporting the recording medium, and the shaft is provided substantially parallel to the central axis of the support.

8. A device according to claim 7, wherein the shield is formed from a plurality of substantially rectangular plates, each plate having one side being provided along the shaft and extending from the shaft to a vicinity of the inner peripheral surface of the support.

9. A device according to claim 8, wherein the plates are spaced apart at substantially uniform intervals along a circumferentially extending direction of the inner peripheral surface of the support.

10. A device according to claim 8, wherein at least a portion of each of the plates is flexible.

11. A device according to claim 7, wherein the shield is formed from a plate fanning substantially orthogonally outward from the shaft to a vicinity of the inner peripheral surface of the support.

12. A device according to claim 11, wherein at least a portion of the plate in the vicinity of the peripheral surface of the support is flexible.

13. The device according to claim 1, wherein the shield is provided only on the side of the mirror from which the light beam is received.

14. An inner drum type image recording device for use in recording an image on a recording medium with a light beam, the device comprising:

a support having an arcuate cross-section, with an inner peripheral surface for receiving the recording medium in contact therewith;

a spinner mirror provided so as to be rotatable around an axis extending substantially parallel to the inner peripheral surface of the support, and due to the spinner mirror rotating, the light beam radiating from a direction substantially parallel to said axis is reflected for performing main scanning of the recording medium received on the inner peripheral surface of the support, and while the recording medium is being main scanned, the spinner mirror moves lengthwise along the axis for performing subscanning of the recording medium such that an image is recorded on the recording medium in accordance with the reflected light beam; and a baffle provided along a direction from which the light beam radiates, between the spinner mirror and the light beam for blocking scattered reflections of the light beam from the mirror, the mirror including a rear side facing away from the baffle towards a space substantially devoid of structure for blocking scattered reflections of the light beam reflected by the mirror.

15. An inner drum type image recording device according to claim 14, wherein the baffle is formed by a plurality of substantially rectangular plates, each plate having one side provided along the axis of the spinner mirror and extending radially to a vicinity of the inner peripheral surface of the support.

16. An inner drum type image recording device according to claim 15, wherein each plate includes a portion in a vicinity of the inner peripheral surface of the support, that is flexible.

17. An inner drum type image recording device according to claim 16, wherein said portion of the plate is formed from at least one of bristles and fabric.

18. An inner drum type image recording device according to claim 14, wherein the baffle is formed by a plate having an inner peripheral end provided at least partially around the axis of rotation of the spinner mirror and fanning outward to a vicinity of the inner peripheral surface of the support.

19. An inner drum type image recording device according to claim 18, wherein a portion of the plate in a vicinity of the inner peripheral surface of the support, is flexible.

20. An inner drum type image recording device according to claim 19, wherein said portion of the plate is formed from at least one of bristles and fabric.

21. A method for blocking scatter reflections of a light beam from a spinner mirror in a drum type image recording device having a drum in which a recording medium is received, the method comprising:

(a) main scanning the recording medium in the drum by receiving the light beam with the spinner mirror and rotating the spinner mirror to reflect the light beam circumferentially, relative to the drum, along the recording medium;

(b) subscanning the recording medium by moving the spinner mirror lengthwise along the drum, while performing main scanning to reflect the light beam transversely, relative to a direction in which main scanning is performed, along the recording medium;

(c) moving a light shield in correspondence with the mirror to impede optical paths in reflection scatter directions from the mirror to sections of the recording medium which have been main scanned with the light beam; and (d) leaving optical paths in reflection scatter directions substantially unimpeded from the mirror to sections of the recording medium, which have not been main scanned.

* * * * *